US011396752B2

(12) United States Patent
Chevillard

(10) Patent No.: US 11,396,752 B2
(45) Date of Patent: Jul. 26, 2022

(54) SHINGLE WITH MELT-BLOWN FIBER BACKING

(71) Applicant: TAMKO Building Products LLC, Joplin, MO (US)

(72) Inventor: Cyril Chevillard, Carl Junction, MO (US)

(73) Assignee: TAMKO BUILDING PRODUCTS LLC, Joplin, MO (US)

( * ) Notice: Subject to any disclaimer, the term of this patent is extended or adjusted under 35 U.S.C. 154(b) by 0 days.

(21) Appl. No.: 16/432,481

(22) Filed: Jun. 5, 2019

(65) Prior Publication Data

US 2019/0376291 A1 Dec. 12, 2019

Related U.S. Application Data

(60) Provisional application No. 62/682,674, filed on Jun. 8, 2018.

(51) Int. Cl.

| | |
|---|---|
| ***B05D 1/12*** | (2006.01) |
| ***B05D 7/24*** | (2006.01) |
| ***D06N 5/00*** | (2006.01) |
| ***E04D 1/20*** | (2006.01) |
| ***E04D 1/26*** | (2006.01) |
| *E04D 1/00* | (2006.01) |

(52) U.S. Cl.

CPC ..... *E04D 1/20* (2013.01); *B05D 1/12* (2013.01); *B05D 7/24* (2013.01); *D06N 5/00* (2013.01); *E04D 1/26* (2013.01); *B05D 2252/10* (2013.01); *E04D 2001/005* (2013.01)

(58) Field of Classification Search

CPC ..... E04D 1/20; E04D 1/26; E04D 2001/005; E04D 1/28; D06N 5/00; B05D 7/24; B05D 1/12; B05D 2252/10

See application file for complete search history.

(56) References Cited

U.S. PATENT DOCUMENTS

| | | | | |
|---|---|---|---|---|
| 5,271,883 | A * | 12/1993 | Timmons | D04H 1/4291 156/167 |
| 6,341,462 | B2 * | 1/2002 | Kiik | E04D 1/20 52/518 |
| 6,391,131 | B1 | 5/2002 | Newman et al. | |
| 2010/0005745 | A1 | 1/2010 | Harrington, Jr. | |
| 2015/0125696 | A1 * | 5/2015 | Fedorova | D04H 3/16 428/401 |
| 2015/0240494 | A1 | 8/2015 | Kiik et al. | |

(Continued)

*Primary Examiner* — Francisco W Tschen
(74) *Attorney, Agent, or Firm* — Husch Blackwell LLP

(57) ABSTRACT

An asphalt coated roofing shingle including a mat substrate saturated with asphalt, a top asphalt layer on a top surface of the mat, a bottom asphalt layer on a bottom surface of the mat, a granular layer on the top asphalt layer and a layer of melt-blown fibers applied to the bottom asphalt layer. A method for making a lightweight roofing shingle including the steps of saturating a mat substrate wherein the mat substrate has a top surface and a bottom surface; applying a top asphalt layer to the top surface; applying a bottom asphalt layer to the bottom surface; applying a layer of granular material to the top asphalt layer opposite the mat after the top asphalt layer is applied to the top surface; and applying a layer of melt-blown fibers directly to the bottom asphalt layer after the bottom asphalt layer is applied to the mat substrate.

13 Claims, 3 Drawing Sheets

(56) References Cited

U.S. PATENT DOCUMENTS

| | | | |
|---|---|---|---|
| 2016/0244969 | A1 | 8/2016 | Beerer et al. |
| 2016/0369509 | A1 | 12/2016 | Leitch et al. |
| 2017/0015042 | A1 | 1/2017 | Leitch et al. |

* cited by examiner

SHINGLE WITH MELT-BLOWN FIBER BACKING

CROSS-REFERENCE TO RELATED APPLICATION

This application claims priority to U.S. Provisional Patent Application No. 62/682,674, filed Jun. 8, 2018, entitled "Shingle with Melt-Blown Fiber Backing" filed by TAMKO Building Products, Inc., the entire disclosure of which is incorporated herein by reference.

FIELD OF THE INVENTION

This present invention relates to an asphalt roofing shingle wherein melt-blown fibers are deposited on the back of the shingle to replace the fine aggregate of conventional shingles.

BACKGROUND OF THE INVENTION

The fine granular aggregate material used to coat the bottom surface of a roofing shingle has increased in cost, especially when purchased and used in high volume, as in the roofing shingle manufacturing process. The fine particulates in the aggregate, which often include sand, are generally abrasive and penetrate the manufacturing equipment and their abrasive edges cause serious wear and tear to the rollers, drums, gears and other mechanisms associated with the equipment. As such, the maintenance, repair, and replacement of parts and equipment of the manufacturing line also incurs great cost. Further, fine aggregate particulates typically require use of conventional engineering controls and sometimes personal protective equipment to control both personal exposure to employees and emissions to the environment of silica or other dusts, which increases the production costs of manufacturing fine-backed asphalt roofing shingles.

Further, hail storms costs homeowners and insurance companies a substantial amount of money each year. There have been many attempts to develop impact resistant shingles by many shingle manufacturers. Various approaches have been introduced, but the existing designs have varying degrees of success.

Thus, there is a need in the art for an asphalt roofing shingle that does not use conventional fine granular aggregate material, but maintains substantially the same or improved performance characteristics when compared to conventional asphalt shingles. There is a further need in the art to provide a shingle which eliminates the use of the fine aggregates or granular material applied to the back surface to reduce the cost of manufacture and to protect the manufacturing employees from being exposed to the fine aggregate dusts and particulates, while also providing substantially the same or improved performance characteristics when compared to conventional asphalt shingles. Further, there is a need in the art for impact resistant shingles that are lightweight, effective, and that maintain the impact resistant nature throughout the shingle's design life while also improving manufacturing conditions.

SUMMARY OF THE INVENTION

The present invention is directed toward a roofing shingle that includes a layer of melt-blown fibers on a bottom surface of the shingle and a method for making the same. In one embodiment, a roofing shingle of the present invention may comprise a mat having a top surface and a bottom surface. A top asphalt layer may be applied to the top surface of the mat and a bottom asphalt layer applied to the bottom surface of the mat. A layer of granular material may be applied to the top asphalt layer opposite the mat, and a layer of melt-blown fibers may be applied directly to the bottom asphalt layer opposite the saturated mat.

The roofing shingle may also include mat substrate being saturated with an asphalt-based material. Further, in one embodiment, the layer of melt-blown fibers has a thickness in a range between 0.1 and 2 millimeters. In another embodiment, the roofing shingle may have a class 4 rating under UL 2218; however, classes 1-3 may also be within the scope of the present invention. Further, an embodiment of the present shingle may include the layer of melt-blown fibers being at least one of polyethylene, black polypropylene, a polyamide, polyolefin, polyester, PET, polyamide and any combination thereof.

The present invention may also include one embodiment of a method for making a lightweight roofing shingle comprising saturating a mat substrate, said mat substrate having a top surface and a bottom surface, applying a top asphalt layer to the top surface, applying a bottom asphalt layer to the bottom surface, applying a layer of granular material to the top asphalt layer opposite the mat after the top asphalt layer is applied to the top surface; and applying a layer of melt-blown fibers directly to the bottom asphalt layer after the bottom asphalt layer is applied to the mat substrate.

The applying the layer of melt-blown fibers step may include applying the layer melt-blown fibers to cover the entire bottom surface of the mat substrate. In another embodiment; however, the applying the layer of melt-blown fibers step may alternatively include the steps of applying said layer melt-blown fibers to specific pre-identified zones on the bottom surface, and retaining one or more zones on the bottom surface that are left substantially free of melt-blown fibers.

Another embodiment of the present invention includes a method for making a lightweight roofing shingle that may comprise the steps of saturating a mat substrate, wherein the mat substrate having a top surface and a bottom surface, applying a top asphalt layer to the top surface, and applying a layer of granular material to the top asphalt layer opposite the mat. This method may further comprise the steps of applying a layer of melt-blown fibers directly to the bottom surface of the mat substrate.

In this embodiment, the applying the layer of melt-blown fibers step comprises applying the layer melt-blown fibers to cover the entire bottom surface of the mat substrate. In another embodiment, the method may comprise the steps of applying said layer melt-blown fibers to specific pre-identified zones on the bottom surface, and retaining one or more zones on the bottom surface that are left substantially free of melt-blown fibers.

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawings form a part of the specification and are to be read in conjunction therewith, in which like reference numerals are employed to indicate like or similar parts in the various views, and wherein.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

The present invention relates to an asphalt roofing shingle of substantially conventional construction with an improvement wherein melt-blown polymer fiber is applied to the back of the asphalt coated mat to replace the fine granular aggregate material currently implemented on conventional asphalt roofing shingles. One embodiment utilizes polypropylene melt-blown fibers. One embodiment may also impart improved impact resistive qualities of the shingle. In one embodiment, the present shingle will have a melt-blown fiber layer that provides the shingle with a Class 4 impact resistance rating under UL 2218; however, the present shingle may also be in classes 1-3 under UL 2218.

Melt-blowing is a known fabrication method of micro- and nanofibers where a polymer melt is extruded through small nozzles surrounded by high speed blowing gas. The randomly deposited fibers form a nonwoven sheet product that may be commonly used for filtration media, sorbents, apparels and drug delivery systems. In the present application, instead of forming a standalone sheet product, the present invention deposits a layer of melt-blown polymer on the bottom side of a substrate used for roofing materials, including asphalt roofing shingles. In one embodiment, the melt-blown fiber may be polypropylene blown fibers that are very thin fibers that stick together as they reach the substrate. In another embodiment, the fiber material may be polyethylene, black polypropylene, polyethylene, a polyamide, polyolefin, polyester, PET or Polyamide or any mixture or combination thereof. This provides for the coverage to be precise and to depend on the distance between the die 48 and the substrate 14. Polypropylene fibers are by nature similar to oil; therefore, the fiber may then absorb the asphalt applied to the bottom surface of the saturated mat. In one embodiment, the layer of melt-blown fibers may be heated to partially melt the fibers already placed on the substrate.

Figure 1:
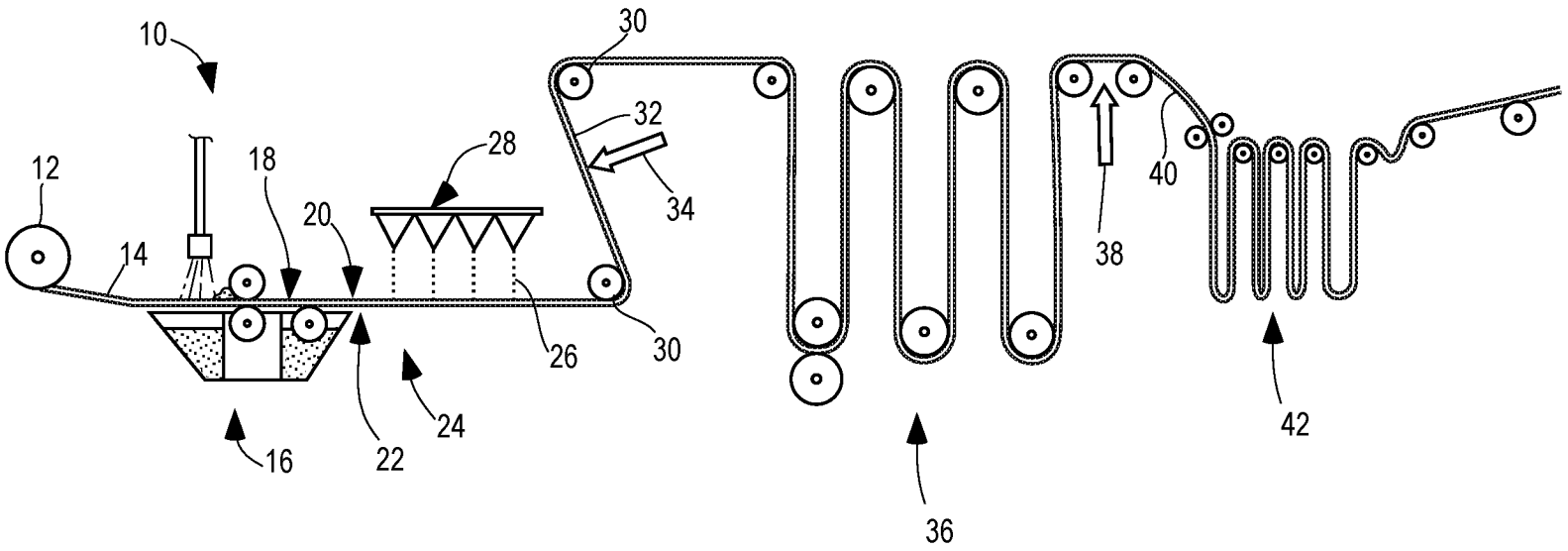
FIG. 1 is a schematic side view of one embodiment of a machine for manufacturing asphalt roofing shingles in accordance with the teachings of the present disclosure.
Figure 2:
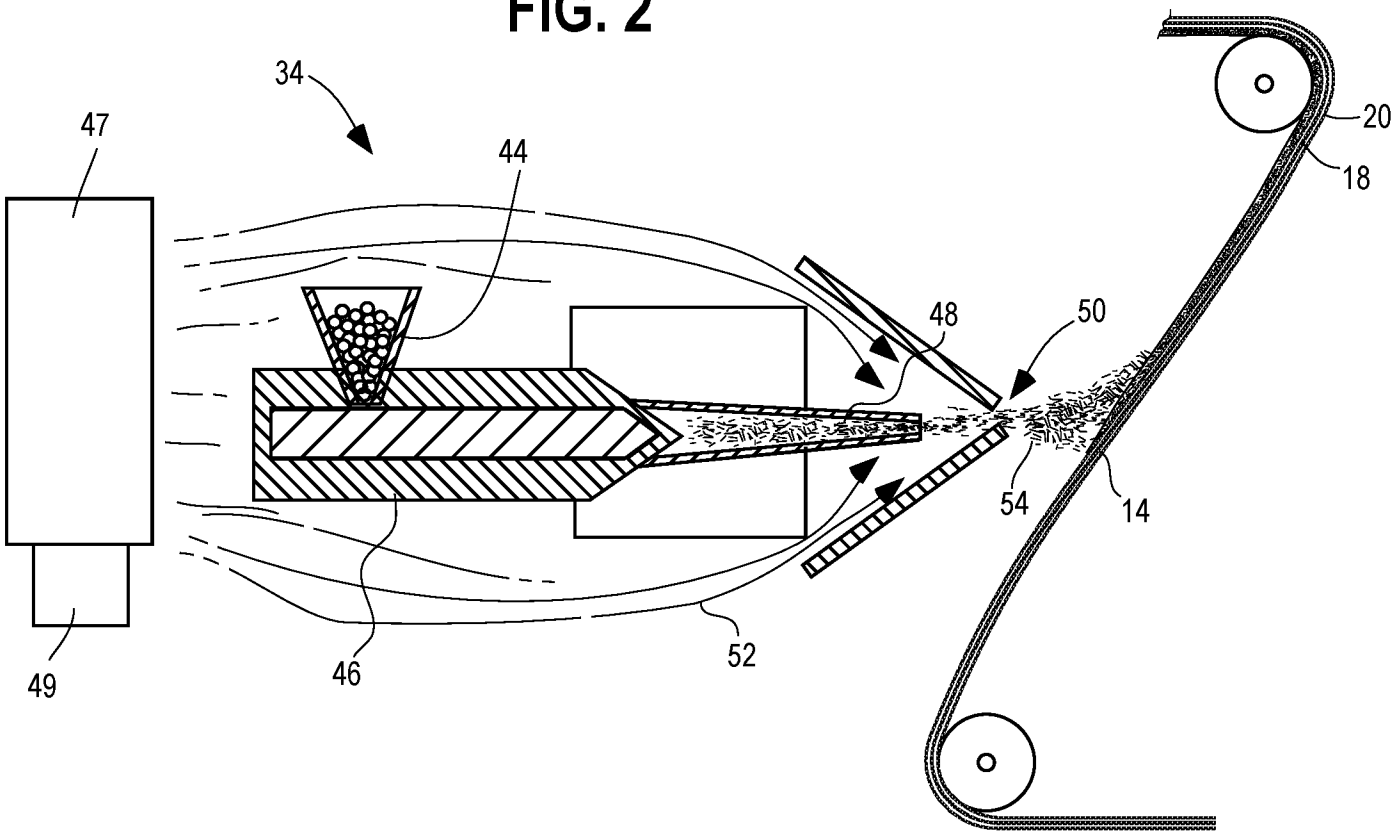
FIG. 2 is an enlarged portion of the schematic side view of FIG. 1 showing one embodiment of a device to apply melt-blown fibers to a shingle substrate in accordance with the teachings of the present invention.
Figure 3:
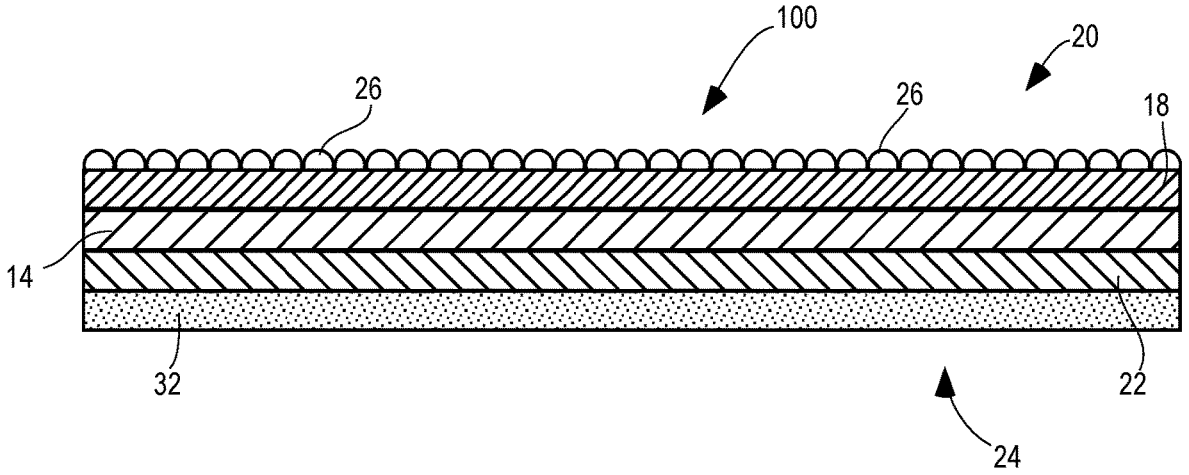
FIG. 3 is a schematic section view of one embodiment of an asphalt roofing shingle showing the layers applied in accordance with the teachings of the present disclosure.

FIG. 1 illustrates one embodiment of a shingle manufacturing line 10 of the present invention. As shown, a roll 12 of a substrate 14 material feeds an asphalt coater 16, wherein (as shown in FIGS. 2 and 3) a top asphalt layer 18 is applied to a top surface 20 and a bottom asphalt layer 22 is applied upon a bottom surface 24 of the substrate 14. Turning back to FIG. 1, the top surface 20 of coated substrate 14 is covered with granules 26 distributed from blender 28. The coated substrate 14 continues through a series of rollers 30 wherein a first melt-blown fiber layer 32 is applied to coat bottom surface 24 of substrate 14 prior to the bottom surface 24 engaging a roller 30 by a first melt-blown fiber machine 34. In one embodiment, some of the melt-blown fibers may melt into the asphalt coating layer if the residual asphalt temperature is high enough at the time the melt-blown fibers are applied. In another embodiment, some fibers of the melt-blown fibers may absorb some of the asphalt on the bottom asphalt layer.

As further shown in FIG. 1, the coated substrate 14 that has the first melt-blown layer 32 deposited on the bottom surface 24 travels through a cooling section 36. In an embodiment shown in FIG. 1, a second melt-blown fiber machine 38 may be disposed downstream of the cooling section to apply a second melt-blown fiber layer 40 onto bottom surface 24. However, a process and shingle manufacturing machine may only include one melt-blown fiber coating station at either the location of the first or second stations as shown in FIG. 1. The location of the melt-blown fiber coating station may also depend upon the desired or optimal temperature of the asphalt coating layer 22 for the melt-blown fiber materials being deposited. In another embodiment, the melt-blown fiber machine or machines may be located at any position along the length of the shingle manufacturing machine. The fully coated substrate 14 may be conveyed through a finished product looper 42 and then to a cutting machine (not shown) to be cut into individual roofing shingles 100 (see FIG. 3) or other rolled or sheet roofing products.

Now turning to FIG. 2, an embodiment of melt-blown fiber machine 34 is shown. Melt-blown fiber machine 34 may comprise a hopper 44 for storing and dispensing polymer material, an extruder 46 that feeds the polymer material to an extruder nozzle/die 48 through which liquid polymer exits the extruder 46, and wherein a compressed air source/blower 47 and heater 49 blows a stream of hot air 52 through a fiber exit nozzle 50. There are a number of compressed air sources and heaters which can be arranged by a person of skill in the art. The polymer is extruded as individual fibers 54 of a small diameter in a melted or liquid state, wherein the stream of hot air 52 propels the individual fibers 54 against bottom surface 24 of bottom asphalt layer 22 of substrate 14. There are a number of melt-blown fiber machines known in the art and any such melt-blown fiber machine or applicator now known or developed in the future.

The polymer may be any polymer known to be used for melt-blown applications, and in one embodiment the polymer is polypropylene. In one embodiment, the melt-blown fiber machine 34 includes the hopper 44, extruder 46, and blower 47 being adapted to fit the space allowed by an existing shingle manufacturing machine. In another embodiment, a width of the melt blown die 48 is sufficient enough to cover the width of the entire sheet of substrate 14.

FIG. 3 illustrates an embodiment of the present asphalt roofing shingle 100 comprising a substrate 14 having a top asphalt layer 18 applied to top surface 20 and bottom asphalt layer 22 applied to bottom surface 24 of substrate 14. The top surface 20 of coated substrate 14 is covered with granules 26 distributed from blender 28. The bottom surface 24 of coated substrate 14 is covered with a melt-blown fiber layer 32. In this embodiment, melt-blown fiber layer 32 replaces fine aggregate or other anti-sticking layer applied upon bottom surface 24 in conventional roofing material or shingle construction. In one embodiment, melt-blown fiber layer 32 may be continuous across the width of substrate 14. In one embodiment, melt-blown fiber layer 32 may be discontinuous across the width of substrate 14 which, in one embodiment, may leave exposed areas or strips of the bottom asphalt layer. In one embodiment of the discontinuous application, the melt-blown fiber layer 32 may be strategically applied areas of the shingle, such as the head lap, overlap of the headlap and tab portions or other strategic locations on the manufactured shingle.

Substrate 14 may be any base mat or substrate currently used in the construction of asphalt shingles including fiberglass, polyester, carbon fiber, or organic felt mats, or any other mats now known or hereafter developed for use as an asphalt shingle substrate. Substrate 14 may be saturated with asphaltic material prior to being coated with asphalt coating layers 18 and 22. Alternatively, the top and bottom coating layers 18 and 22 may be used to saturate the substrate 14 when they are applied. Asphalt coating layers 18 and 22 may be any asphaltic material formulation now known used to cover asphalt shingles or other roofing materials or membranes, including asphalt modified with any known additives or performance altering admixtures. Asphalt coating 18 and 22 may include aggregate filler added to the asphaltic material and mixed therein to promote adhesion and to increase the creep resistance of the mixture under elevated temperatures experienced on a roof.

Granular material 26 may be any granular material now used or hereafter used for asphalt shingles that at least (1) cover the top asphalt layer 18, (2) provide a weathering surface, (3) shield the top asphalt layer 18 from UV light when installed on the roof, and/or (4) contribute to the overall appearance and/or color of an asphalt shingle.

The embodiments of the present shingle described above may be made using one or more of the following steps. In one embodiment, substrate 14 may be saturated with asphaltic material by submerging substrate 14 in asphaltic material or coating substrate 14 with asphaltic material as known in the art. Next, the asphalt coating layer may be applied to the saturated substrate 14 separately. Alternatively, the asphalt coating layers 18 and 22 may be applied simultaneously with the saturating step above, or the asphalt coating layers 18 and 22 may be configured to absorb into and/or saturate the substrate 14. In one embodiment, top asphalt layer 18 is applied to substrate 14 or, alternatively, top asphalt layer 18 may be applied to top surface 20 and bottom asphalt layer 22 may be applied to bottom surface 24 of substrate 14 using the same equipment currently used to manufacture conventional asphalt shingles. If both top surface 20 and bottom surface 24 of substrate 14 are coated with a coating layer of asphaltic material (asphalt layers 18 and 22), the exposed granular material 26 may then be applied to the top asphalt coating layer 18 opposite the substrate 14 using one of the many known processes in the art at any time in the manufacturing process or other similar process developed in the future.

In one embodiment, a layer of melt-blown fibers 32 is applied to the bottom surface 24 of the coated substrate 14 prior to the bottom surface 24 engaging a roller. In yet another embodiment, a second layer 40 of melt-blown fibers may be applied to the bottom surface 24 of the coated and cooled substrate 14 after processing, but before cutting the substrate into individual shingles or other roll or sheet roofing products. In one embodiment, melt-blown fiber layer 32 is applied as a continuous layer across the width of substrate 14. This may result in the entire bottom surface of the shingle being covered by the melt-blown fiber layer 32 and/or 40. In one embodiment, melt-blown fiber layer 32 is applied as a discontinuous across the width of substrate 14. This may result in the zones of the bottom surface of the shingle being covered by the melt-blown fiber layer 32 and/or 40 and zones of the bottom surface of the shingle being uncovered with the bottom asphalt layer or the bottom of the mat substrate being exposed or substantially free of melt-blown fibers. The locations of these zones may be pre-determined by the shingle designer and engineers to reduce weight, strategically reinforce the shingle construction, or otherwise improve shingle performance, manufacturing efficiency, or worker safety.

Melt-blown fiber layers 32 and 40 may be the same or different thickness. Melt-blown fiber layer 32 may have a thickness in a range of 0.1 and 2 millimeters (mm), with a preferable thickness between 0.5 and 0.8 millimeters (mm) if no second layer is applied and a thickness of 0.2 and 0.5 mm if a second layer 40 is to be applied. Similarly, if applied, second melt-blown fiber layer 40 may have a thickness in a range of 0.5 and 0.8 millimeters (mm), with a preferable thickness between 0.2 and 0.5 millimeters (mm).

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

I claim:

1. A method for making a lightweight roofing shingle comprising:

saturating a mat substrate, said mat substrate having a top surface and a bottom surface;

applying a top asphalt layer to the top surface;

applying a bottom asphalt layer to the bottom surface;

applying a layer of granular material to the top asphalt layer opposite the mat after the top asphalt layer is applied to the top surface; and applying a plurality of individual melt-blown fibers directly to the bottom asphalt layer to form a layer of melt-blown fibers on the bottom asphalt layer after the bottom asphalt layer is applied to the mat substrate wherein the plurality of individual melt-blown fibers are applied to the bottom asphalt layer when the bottom asphalt layer is in a liquid state.

2. The method of claim 1 wherein said applying the plurality of individual melt-blown fibers step comprises applying the plurality of individual melt-blown fibers to form the layer, wherein the layer covers the entire bottom surface of the mat substrate.

3. The method of claim 1 further comprising the steps of applying said plurality of individual melt-blown fibers to specific pre-identified zones on the bottom surface, and retaining one or more zones on the bottom surface that are left substantially free of melt-blown fibers.

4. The method of claim 1 wherein the plurality of individual melt-blown fibers are at least one of polyethylene, black polypropylene, a polyamide, polyolefin, polyester, PET, polyamide and any combination thereof.

5. The method of claim 1, wherein the layer of melt-blown fibers has a thickness in a range between 0.5 and 0.8 millimeters.

6. The method of claim 1, wherein a portion of the plurality of individual melt-blown fibers absorbs a portion of the bottom asphalt layer.

7. The method of claim 1, further comprising the step of heating the layer of melt-blown fibers to partially melt a portion of the plurality of individual melt-blown fibers after applying the plurality of individual melt-blown fibers directly to the bottom asphalt layer.

8. The method of claim 1, wherein a portion of the plurality of individual melt-blown fibers may melt into the bottom asphalt coating layer.

9. A method for making a lightweight roofing shingle comprising:

saturating a mat substrate, said mat substrate having a top surface and a bottom surface;

applying a top asphalt layer to the top surface;

applying a layer of granular material to the top asphalt layer opposite the mat; and applying a plurality of individual melt-blown fibers directly to the bottom surface of the mat substrate to form a layer of melt-blown fibers on the bottom asphalt layer wherein the plurality of individual melt-blown fibers are applied to the bottom asphalt layer when the bottom asphalt layer is in a liquid state.

10. The method of claim 9 wherein said applying the layer of melt-blown fibers step comprises applying the plurality of individual melt-blown fibers, wherein the layer covers the entire bottom surface of the mat substrate.

11. The method of claim 9 further comprising the steps of applying the plurality of individual melt-blown fibers to specific pre-identified zones on the bottom surface, and retaining one or more zones on the bottom surface that are left substantially free of melt-blown fibers.

12. The method of claim 9 wherein the plurality of individual melt-blown fibers are at least one of polyethylene, black polypropylene, a polyamide, polyolefin, polyester, PET, polyamide and any combination thereof.

13. The method of claim 9, wherein the layer of melt-blown fibers has a thickness in a range between 0.5 and 0.8 millimeters.

* * * * *